United States Patent [19]

Rolf

[11] Patent Number: 4,803,313

[45] Date of Patent: Feb. 7, 1989

[54] ELECTRIC SWITCH WITH SEALED PLURAL COMPARTMENTS

[75] Inventor: Wilfried Rolf, Oberursel, Fed. Rep. of Germany

[73] Assignee: Braun Aktiengesellschaft, Kronberg, Fed. Rep. of Germany

[21] Appl. No.: 132,349

[22] Filed: Dec. 14, 1987

[30] Foreign Application Priority Data

Dec. 23, 1986 [DE] Fed. Rep. of Germany ..... 3644212

[51] Int. Cl.[4] ..... H01H 21/08

[52] U.S. Cl. ..... 200/6 BB; 200/574; 200/241; 200/302.1

[58] Field of Search ..... 200/6 B, 6 BA, 6 BB, 200/153 LB, 138 R, 241, 302.1

[56] References Cited

U.S. PATENT DOCUMENTS 3,283,105 11/1966 Locke et al. ..... 200/153 R
3,737,598 6/1973 Kudoh et al. ..... 200/38 R
4,059,738 11/1977 Mongeau ..... 200/6 B
4,081,632 3/1978 Schaffeler ..... 200/153 LB
4,617,437 10/1986 Durocher ..... 200/18

FOREIGN PATENT DOCUMENTS 8310491 4/1983 Fed. Rep. of Germany .
721690 1/1955 United Kingdom ..... 200/6 BB

*Primary Examiner*—A. D. Pellinen
*Assistant Examiner*—Morris M. Ginsburg

[57] ABSTRACT

The invention is directed to an electric switch having a shaft (33) with a switching coulisse (36) comprising two circular segments, with control cams (60, 64) being disposed on the one circular segment and ratchet elements (66) being disposed on the other circular segment, which cooperate with a detent spring (75) and a contact spring (70). Because the circular segments are arranged il a common plane, a highly compact switch is obtained.

11 Claims, 4 Drawing Sheets

1/4

ELECTRIC SWITCH WITH SEALED PLURAL COMPARTMENTS

This invention relates to an electric switch having a shaft rotatably carried in a switch housing, said shaft including a switching coulisse having at least one control cam, said switching coulisse rotating to thereby displace a contact spring between at least two switching positions and in the one switching position bringing the contact spring into abutment with a fixed contact element.

A built-in electric switch with a switch housing is already known (German Utility Patent DE-GM No. 83 01 491) in the interior of which a fixed contact element and a movable contact element are arranged. The movable contact element is connected via a semicircular protuberance to a vertically extending web serving at the same time as contact element for a connecting lead. By means of a switching coulisse incorporating a cam, the movable contact element is adapted to swing from its off position to its on position. To avoid accidental displacement of the switching coulisse, a ratchet wheel is provided on the shaft at an axial distance from the switching coulisse, said ratchet wheel having a tooth profile for engagement with a detent spring.

Further, an electric switch is known (DE-AS No. 24 51 034) which is equipped with a switching coulisse on which a cam operatively associated with a movable contact element is eccentrically arranged. Via a V-shaped leg and an arcuate adapting piece, the contact element is connected with a vertically arranged leg extending through the housing and serving as connecting terminal for an electrical lead. Turning of the switching coulisse causes the movable contact element to be urged against a supporting member provided at the bottom of the housing. Further turning of the control cam causes the movable contact element to move along the arc of a circle until it abuts on a fixed contact element. Arranged on the same shaft as the switching coulisse and axially spaced therefrom is a ratchet wheel which cooperates with a detent spring, locking the control cam in specific positions.

In contrast to these arrangements, the solution of the invention affords the advantage of permitting the switch to be built to smaller dimensions while the electrical power is the same or even greater, so that less space has to be provided for mounting the switch in the appliances concerned as, for example, kitchen appliances, hair dryers, or coffee makers.

The invention is characterized in that in a switch of the type initially referred to the switching coulisse is comprised of a first circular segment on which at least one control cam is disposed, and of a second circular segment on which ratchet elements are disposed, with the two circular segments being arranged in a common plane.

By integrating the switching coulisse and the ratchet elements to form a single disk-shaped component, it is possible to keep the space requirements inside the switch housing at a minimum, enabling the switch housing to be built to very small dimensions.

Advantageously, the movable contact element connected with the contact spring is adapted to be displaced by the control cam along the curved path of varying radius. In this manner, abutment of the control cam upon the contact spring causes the movable contact element to be displaced both vertically and horizontally in relation to the fixed contact element provided in the switch housing, so that on abutment of the movable contact element upon the fixed contact element, the movable contact element is horizontally displaced along the surface of the fixed contact element. This counteracts coking of the contact elements because of the continuous self-cleaning action of the contact surfaces. The advantageous movement of the movable contact element is favored by the fact that the contact spring includes a link member connected with the switch housing, said link member having an adjoining circular arc portion, a roof-shaped portion, and finally a straight portion for receiving the movable contact element. Orientation of the circular arc portion and of the roof-shaped portion relative to the control cam is such that on abutment of the control cam upon the contact spring the movable contact element is displaceable first vertically and finally a small amount horizontally in relation to the fixed contact element.

The control cam as well as the ratchet elements are of unitary structure and are arranged on a rotatable body of, for example, cylindrical configuration which provides the switching coulisse. In this arrangement, the circular arc portion for the switching coulisse may enclose an angle of 180°, approximately.

It is also possible to arrange in the circumferential direction on the switching coulisse several cams in succession. It is further possible to provide several control cam disks on the shaft side by side, in which arrangement merely one switching coulisse has to be provided with ratchet elements.

The locking grooves provided on the switching coulisse have substantially larger radii than the detent cams bounding the locking grooves. In this manner, indifferent switching positions and accidental displacement of the switching coulisse are avoided.

In a further embodiment of the invention, it is advantageous to optionally equip the switching coulisse with a toothed segment for engagement with a rack, so that a linearly displaceable control element adapted to provide for rotation of the switching coulisse is substituted for a control element which is displaceable by rotation.

Form and material of the contact spring determine, among other considerations, its defined restoring force. Due to its preferred form, the contact spring is restored very quickly, keeping sparking between the contact surfaces low, thus minimizing coking. In the event that the contact surfaces should still become coked, the sliding motion of the movable contact element on the fixed contact element provides a continuous self-cleaning effect of the contact surfaces. This makes it also possible to deal with higher electrical power than in conventional switches.

To avoid accidents by immersing an electrical appliance when it is turned off, for example, if a hair dryer falls into a filled bathtub, an off/on switch comprising two chambers is waterproofed, and both terminals of the power cord are connected.

Further embodiments of the invention will become apparent from the following description of embodiments of the invention.

The invention will be explained in more detail in the following with reference to the accompanying drawings illustrating several embodiments.

Figure 1:
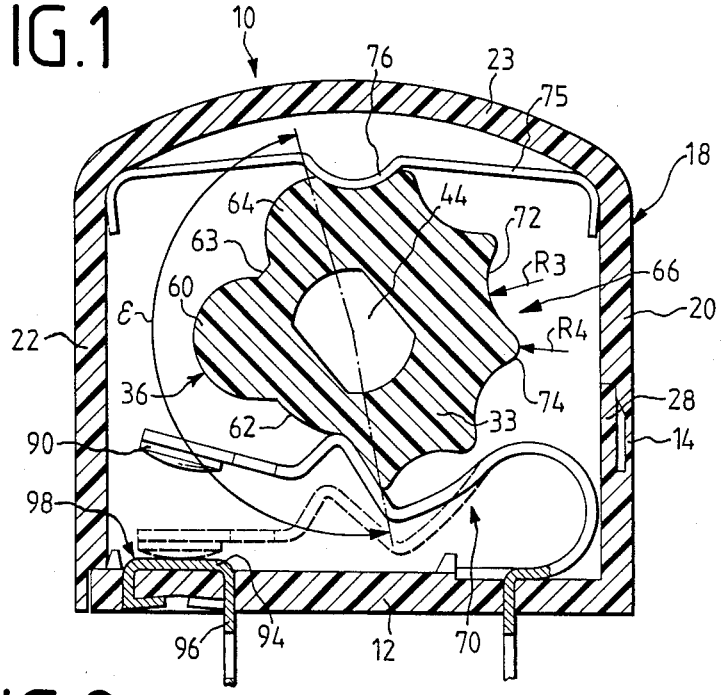
FIG. 1 is a section taken along the line I—I of FIG. 6, illustrating a first embodiment of a switch housing with a switching coulisse disposed on a shaft and a contact spring adapted to be operated by the switching coulisse in unseated position.

The switch housing 10 shown in the Figures is comprised of a bottom 12 and a housing part 18 connected with the bottom 12 through a film hinge 14, said housing part being adapted to swing by 180° and to be placed onto the bottom 12. The housing part 18 has parallel side walls 20 and 22 connected with each other by a domed cover 23. The side walls 20 and 22 are further connected with each other by a front wall 24 and a rear wall 26. If the housing part 18 is swung by 180° and placed onto the bottom 12, the film hinge 14 is in abutment with a supporting member 28 arranged upright on the bottom 12 and preventing displacement of the housing part 18 relative to the bottom 12. Provided on the bottom 12 are one or several wall parts 30 subdividing the bottom 12 together with the housing part 18 into two or more switch chambers of equal size.

Figure 6:
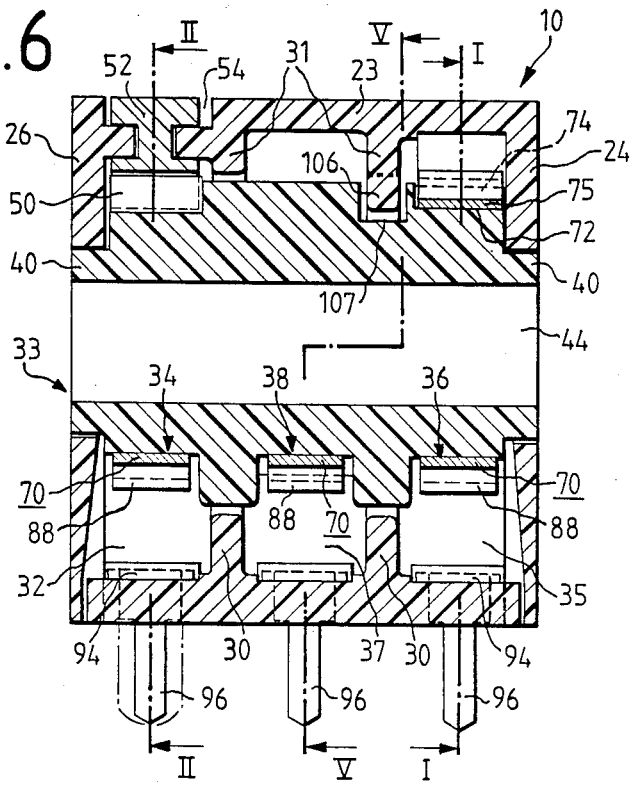
FIG. 6 is a longitudinal sectional view of a switch housing including three switch chambers.

According to FIG. 6, two wall parts 30 are arranged on the bottom 12, thereby providing adjacent switch chambers 32, 37, 35. The individual switch chambers serve to receive the respective switching coulisses identified by reference numerals 34, 38, 36, the respective fixed contact elements 94 and the respective contact springs 70. Corresponding wall parts 31 are provided in the housing cover 23.

As becomes apparent from FIG. 6, the switching coulisses 34, 38, 36 are constituent parts of the shaft 33 which has a flange 40 at either end thereof which is rotatably carried in respective bores 42 provided in the front wall 24 and the rear wall 26, respectively. Extending through the shaft 33 with its switching coulisses 34, 38, 36 is an approximately rectangular opening 44 for accommodating an actuator adapted to rotate the shaft with its switching coulisses.

Figure 2:
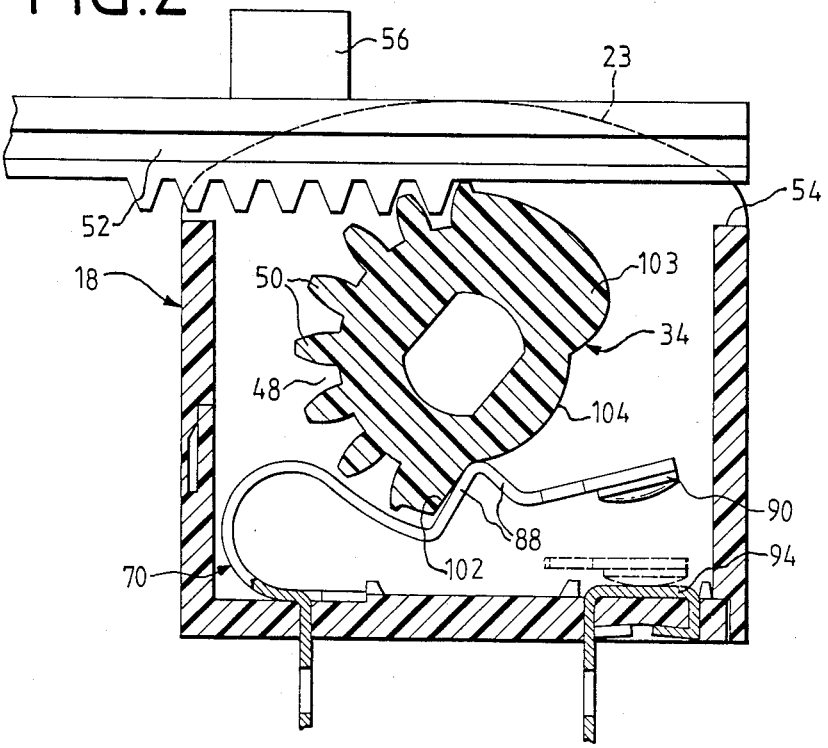
FIG. 2 is a section taken along the line II—II of FIG. 6, illustrating an embodiment of a switching coulisse which is displaceable by a rack.
Figure 3:
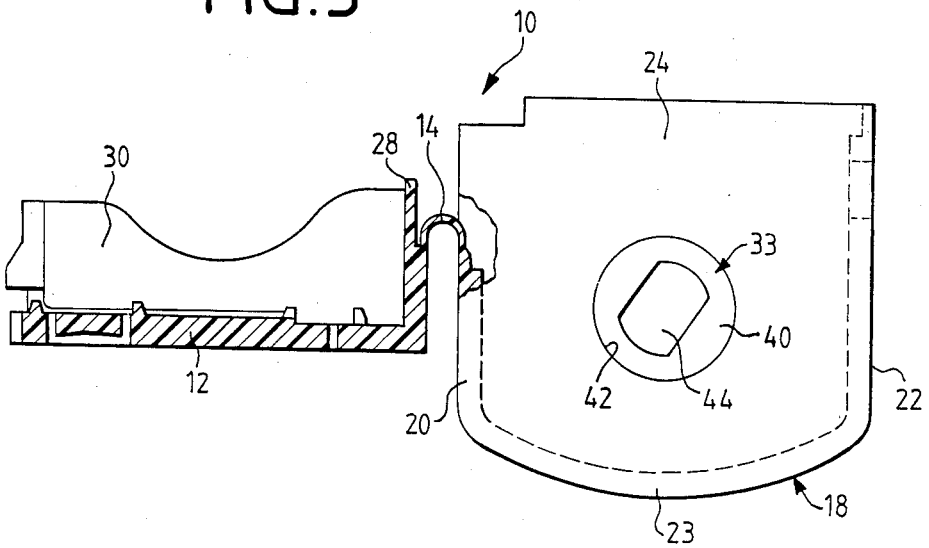
FIG. 3 is a view of the switch housing with a cover hinged to a side wall of the switch housing by means of a film hinge.

As shown in FIG. 2, the switching coulisse 34 has an adjacent tooth segment 48 enclosing an arc measure of about 180°. The individual teeth 50 thereof cooperate with a rack 52 which is slidably carried in an opening 54 provided in the cover 23. Operation of the rack 52 provides for rotation of the shaft 33 with its switching coulisses 34, 38, 36 to the desired switch position. For this purpose, the rack 52 may be provided with a grip member 56.

As shown in FIG. 1, the switching coulisse 36 is comprised of a first circular segment identified by angle $\epsilon$ and enclosing about 180°. On the first circular segment approximately at center is a semicircular control cam 60 with adjacent off positions 62 and 63 to its right and left. In this Figure, another control cam 64 adjoins the off position 63. Adjoining the first circular segment is a second circular segment on which a plurality of adjacent ratchet elements 66 are provided. The ratchet elements 66 as well as the control cams 60, 64 and the off positions 62 and 63 all lie in a common plane, thus forming a relatively small disk. The individual ratchet elements 66 comprise arcuate locking grooves 72 bounded by detent cams 74 on either side.

The radius R3 of a locking groove is substantially larger than the radius R4 of a detent cam. The ratchet elements 66 cooperate with a detent spring 75 provided in the upper part of the switch housing 10. The detent spring 75 has a bulge 76 which is conformed to the profile of the locking grooves 72 and which, by engagement of the bulge 76 with the locking grooves 72, defines and determines the switch positions in cooperation with the contact spring 70. If, for example, the switching coulisse 36 is turned, the detent spring is bulged out upwardly by the action of the detent cams 74, enabling the detent cams to move past the bulge 76 of the detent spring 75 until the bulge 76 has engaged another locking groove 72. Accordingly, the individual adjacent locking grooves 72 represent the individual switch positions of the electric switch. Because the detent spring 75 is loosely arranged in the switch housing 10, switching operations do not produce jamming, and uniform switching forces are ensured. If several adjacent switching coulisses are provided, only one switching coulisse needs to be equipped with ratchet elements 66.

Figure 4:
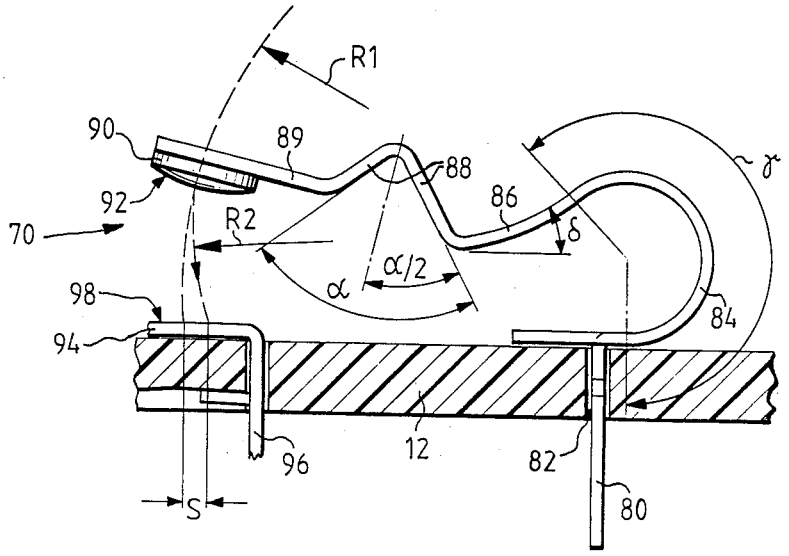
FIG. 4 is a view of the contact spring arranged on the bottom of the switch housing.

As becomes apparent from FIG. 4, the contact spring 70 comprises a link member 80 extending vertically relative to the bottom 12 of the switch housing 10 through an opening 82 in the bottom 12, with the portion thereof protruding from the bottom 12 serving as connection lug for current supply. Adjoining the upper end of the link member 80 is a circular arc portion 84 enclosing an angle $\gamma$ of about 200°. The circular arc portion 84 is continued as a slightly bent portion 86 approximately adapted to the profile of the outer radius of the switching coulisse and forming with the horizontal line of with the bottom 12 an angle $\delta$ of about 30°. This portion 86 is followed by a roof-shaped portion 88 having an angle $\alpha$ of about 80°. Adjoining the roof-shaped portion 88 is a straight portion 89 on which the movable contact element 90 is provided whose contact surface 92 is dome-shaped. Abutment of the contact element 90 with a fixed contact element 94 provided on the bottom 12 is made possible by the action of the control cams 60, 64 on the contact spring 70. The fixed contact element 94 is equally provided with a connection lug 96 for current supply.

If, for example, the switching coulisse 36 is displaced in opposition to the action of the detent spring 75, the end surface of the contact cam 60 will move towards the roof-shaped portion 88 of the contact spring 70, thereby causing the movable contact element 90 to move along a circular path R1 (see FIG. 4) the radius R1 of which may decrease continuously until it is finally at R2. This means that the control cam 60 moves through the contact spring 70 the contact element 90 in the final phase a short distance above the contact surface 98 of the fixed contact element 94 along a curved path, with the contact element 90 travelling a horizontal distance S. Thereby the movable contact element 90 slides a little along the contact surface 98 of the fixed contact element 94, so that this relative movement of the two contact elements 94 and 90 results in a self-cleaning effect of the contact surfaces 98,·92.

The configuration of the detent cams 74 and the locking grooves 72 in combination with the detent spring 75 eliminates the possibility of idifferent switch positions and ensures fast (abrupt) switching operations largely avoiding sparking.

As a result of the advantageous configuration of the contact spring 70, in particular the relatively large curvature 84 which, in combination with the portions 86 and 88, produces a long spring, the desired amount of travel S of the movable contact element 90 along a curved path can be accomplished. The special form and material of the contact spring 70 determine a defined restoring force keeping sparking at a minimum when the movable contact element 90 lifts clear of the fixed contact element 94. The reason for such diminished sparking is that the contact spring 70 moves the movable contact element 90 rapidly upwards as soon as the cam has been moved past the roof-shaped portion 88.

The switching coulisse 34 shown in FIG. 2 which may be provided in addition to the first switching coulisse 36 shown in FIG. 1 may be associated with a second switch chamber 32 which is spaced from the first switch chamber 35. As becomes apparent from FIG. 2, the switching coulisse 34 has no additional ratchet means (locking grooves 72, detent cams 74, detent spring 75) but merely fulfils switching and control functions via the rack 52. In this arrangement, reference numeral 103 identifies the control cam corresponding to the control cams 60 or 64 of FIG. 1, and reference numeral 104 denotes the off position. The roof-shaped portion 88 of the contact spring 70 engages the abutment surface 102 of the switching coulisse 34, bounding the off position 104.

If several switching coulisses are arranged side by side, each coulisse has to be assigned a fixed contact element 94 and a contact spring 70. FIG. 6 shows a switch housing 10 with a shaft 33 comprising three switching coulisses 34, 38, 36, with the additional switching coulisse 38 being arranged between the switching coulisses 34 and 36 and being assigned switch chamber 37.

Figure 5:
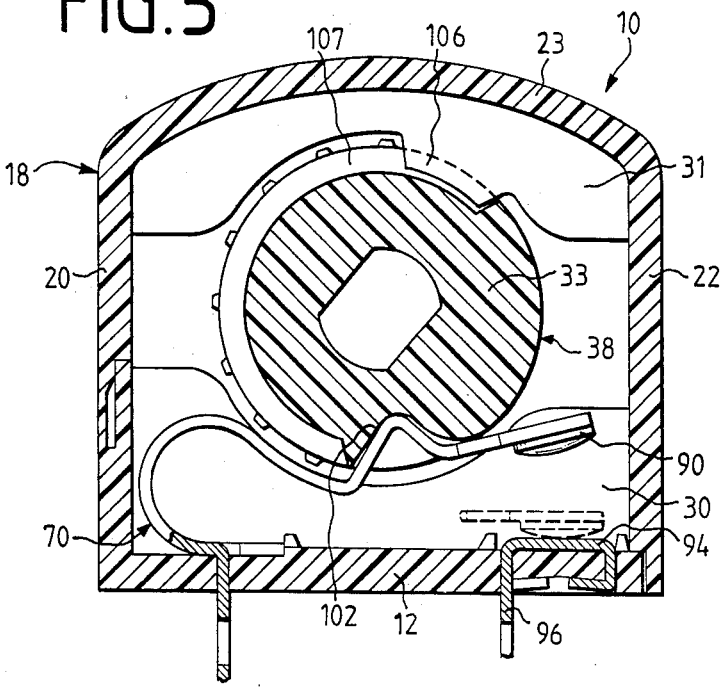
FIG. 5 is a section taken along the line V—V of FIG. 6, illustrating another embodiment of a switching coulisse serving only for switching purposes, and showing further a locking device.

As becomes apparent from FIG. 5 and FIG. 6, a limit device may be provided. For this purpose, a stop 106 is provided in the wall part 31 associated with the switch chamber 35, and a groove 107 is provided in the shaft 33 between the switching coulisses 36 and 38. This limit device is particularly advantageous if the switching coulisses are turned by an actuator in the opening 44.

Figure 8:
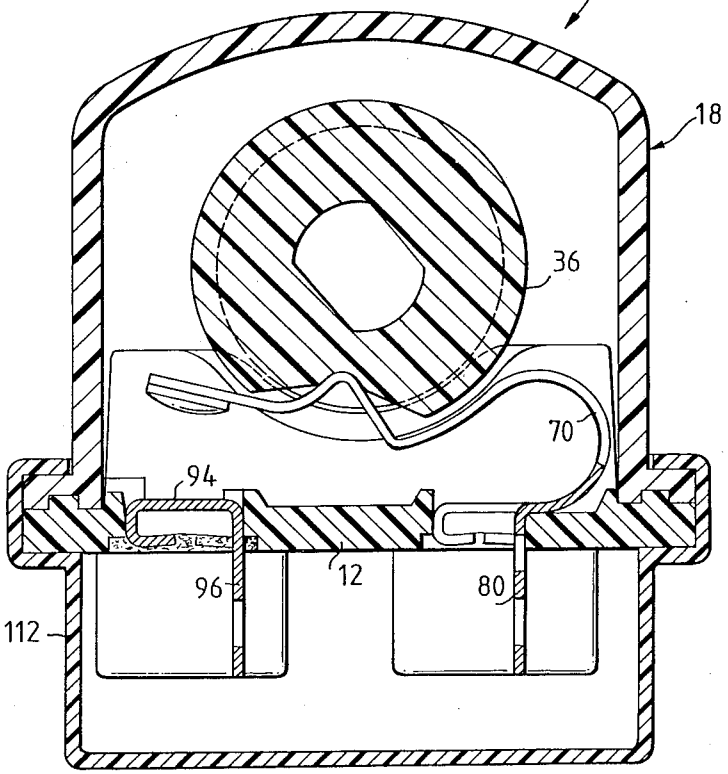
FIG. 8 is a section taken transversally to the shaft of a waterproof dual-chamber switch.
Figure 7:
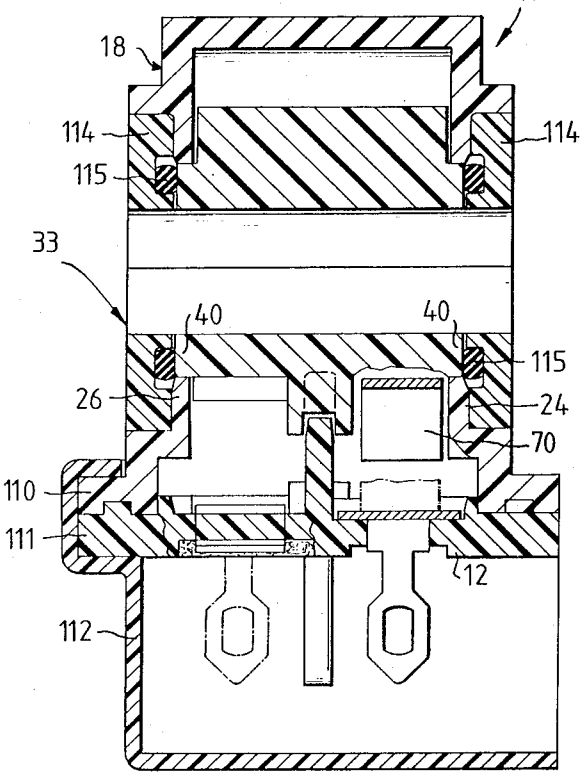
FIG. 7 is a section taken longitudinally to the shaft 33 of a waterproof dual-chamber switch.

FIGS. 7 and 8 show a waterproof on/off switch comprising two chambers. Each chamber includes a switching coulisse 36 as well as a contact spring 70 and a fixed contact element 94 with associated connection lugs 80 and 96. Both terminals of the power cord are connected across these two switch chambers. At least one switch chamber includes a detent spring 75. The two switching coulisses shown here are identical.

The housing part 18 and the bottom 12 which combine to form the switch housing 10 are joined tight by a circumferential rim 110, 111 using ultrasonic welding techniques.

The sealing relative to the front wall 24 and the rear wall 26 of the switch housing in the area of the shaft 33 is accomplished by a respective elastic O-ring 115 engaged pressure-tight intermediate the flange 40 on the end of the shaft 33 and an annular groove of a sealing flange 114. The sealing flange 114 is fitted into the front wall 24 and rear wall 26 and is in positive and waterproof engagement with the walls 24, 26 which is accomplished by ultrasonic welding, for example.

Following soldering of the power cord and the extending cable to the connection lugs 80, 96 projecting form the bottom 12 of the switch housing, an auxiliary mold 112 (sealing cup) made of plastics material is placed over the bottom 12. This auxiliary mold has one side cut out or open for running the cables therethrough and for filling the auxiliary mold with solidifying plastic sealing compound.

The two-terminal on/off operation, the watertight switch and the sealing of the connection lugs and wires prevent the possibility of personal injury should an appliance equipped with such an on/off switch be dropped into water when turned off.

I claim:

1. An electric switch comprising housing structure that defines two chambers, shaft structure rotatably carried in said housing structure, said shaft structure including a flange surface adjacent each end and two axially offset switching coulisses on said shaft structure for rotation therewith, each of said switching coulisses being disposed in a corresponding housing chamber and said housing structure including sealing flange members welded to the front and rear walls of said housing structure, O-rings arranged pressure-tight between said flange surfaces adjacent the ends of said shaft structure and said sealing flange members, each of the housing chambers having a contact spring and a fixed contact element disposed therein and connection lug structure external thereof for providing electrical connection to said contact spring and said contact element, each said contact spring carrying a movable contact element, each of said switching coulisses being adapted to be rotated by said shaft structure to displace its associated contact spring between a first switch position in which said associated contact spring is in abutment with its said fixed contact element and a second position in which said associated contact spring is spaced from its said fixed contact element, a first of said switching coulisses including a first circular segment on which at least one control cam is disposed and a second circular segment on which a series of ratchet elements are disposed, the two said circular segments of the first switching coulisse being arranged in a common plane; and a detent spring loosely arranged in said housing structure, said detent spring including a bulge portion which is conformed to the profiles of said ratchet elements for fixing said switching coulisses in a series of angular positions.

2. An electric switch as claimed in claim 1 wherein each said movable contact element carried by said contact spring is adapted to be displaced by the associated said control cam along a curved path of varying radius (R2, R2).

3. An electric switch as claimed in claim 1 wherein each said contact spring includes a link portion fixed to said switch housing structure, a circular arc portion adjoining said link portion followed by a slightly bent portion and a roof-shaped portion, and finally a straight portion on which its said movable contact element is mounted.

4. An electric switch as claimed in claim 3 wherein said circular arc portion encloses an angle ($\delta$) of more than 180°, preferably between 190° and 210°.

5. An electric switch as claimed in claim 3 wherein said roof-shaped portion of said contact spring encloses an angle ($\alpha$) of less than or equal to 90°.

6. An electric switch as claimed in claim 1 wherein said first circular segment for receiving the at least one control cam encloses an angle ($\epsilon$) of about 180°.

7. An electric switch as claimed in claim 1 wherein said ratchet elements comprise arcuate locking grooves bounded by detent cams, with the radius ($R_3$) of said locking grooves being substantially greater than the radius ($R_4$) of said detent cams.

8. An electric switch as claimed in any one of the claims 1 to 7 and further including rack structure and wherein one of said coulisses includes a tooth segment (48) engaged by said rack structure, said tooth segment being in an axially offset relationship to said control cam or said ratchet elements of the first switching coulisse.

9. An electric switch as claimed in claim 1 wherein said housing structure includes a cover-type housing part, and said cover-type housing part is connected with a housing wall by means of a film hinge.

10. An electric switch as claimed in claim wherein one of said switching coulisses includes a plurality of control cams arranged on said one switching coulisse in circumferential succession.

11. An electric switch as claimed in claim 1 and further including stop structure on said housing structure, said stop structure engaging into a groove in said shaft structure thereby providing a limit device.

* * * * *